US010508783B2

(12) United States Patent
Lawrence

(10) Patent No.: US 10,508,783 B2
(45) Date of Patent: Dec. 17, 2019

(54) FLUSH MOUNT FIXTURE

(71) Applicant: Nicor, Inc., Albuquerque, NM (US)

(72) Inventor: Rocklan E. Lawrence, Albuquerque, NM (US)

(73) Assignee: Nicor, Inc., Albuquerque, NM (US)

( * ) Notice: Subject to any disclaimer, the term of this patent is extended or adjusted under 35 U.S.C. 154(b) by 0 days.

(21) Appl. No.: 16/110,995

(22) Filed: Aug. 23, 2018

(65) Prior Publication Data

US 2019/0063700 A1 Feb. 28, 2019

Related U.S. Application Data

(60) Provisional application No. 62/721,541, filed on Aug. 22, 2018, provisional application No. 62/668,589, filed on May 8, 2018, provisional application No. 62/549,901, filed on Aug. 24, 2017.

(51) Int. Cl.

| | |
|---|---|
| ***F21S 8/02*** | (2006.01) |
| ***F21V 23/00*** | (2015.01) |
| ***F21V 17/12*** | (2006.01) |
| *F21V 21/04* | (2006.01) |
| *F21V 7/04* | (2006.01) |
| *F21Y 115/10* | (2016.01) |

(52) U.S. Cl.

CPC ..... *F21S 8/024* (2013.01); *F21V 17/12* (2013.01); *F21V 23/001* (2013.01); *F21V 23/008* (2013.01); *F21V 7/041* (2013.01); *F21V 21/04* (2013.01); *F21Y 2115/10* (2016.08)

(58) Field of Classification Search

CPC .... F21S 8/024; F21S 8/026; F21S 8/02; F21S 8/03; F21S 8/033; F21S 8/022; F21V 17/12; F21V 23/001; F21V 23/008; F21V 7/041; F21V 21/04; F21V 21/02; F21V 21/041; F21V 21/047; F21V 21/048; F21V 21/049; F21Y 2115/10

See application file for complete search history.

(56) References Cited

U.S. PATENT DOCUMENTS

| | | | | |
|---|---|---|---|---|
| 9,803,814 | B2 * | 10/2017 | Grant | F21S 8/026 |
| 2006/0109660 | A1 * | 5/2006 | Wolf | E04B 9/006 362/365 |
| 2013/0033872 | A1 * | 2/2013 | Randolph | F21K 9/00 362/294 |
| 2015/0276185 | A1 * | 10/2015 | Bailey | F21V 13/04 362/294 |
| 2017/0328547 | A1 * | 11/2017 | Shapiro | F21V 21/30 |

* cited by examiner

*Primary Examiner* — Bao Q Truong

(74) *Attorney, Agent, or Firm* — Loza & Loza LLP; Richard H. Krukar

(57) ABSTRACT

A flush mount fixture can be installed directly into a junction box in ceiling while still meeting safety standards such as fire safety stands and electrical standards. The fixture can be electrically powered directly from the power lines entering the junction box. The components and materials have been designed and selected specifically for installation into a junction box to thereby provide a flush mounted fixture. By meeting all required safety standards, the lighting fixture is easy and quick to install. No additional cans, hanger bars, or similar devices are needed. The fixture's trim is removably attached such that it can be pulled away and replaced by a similar trim piece having a different color or decorative appearance.

20 Claims, 12 Drawing Sheets

FLUSH MOUNT FIXTURE

CROSS-REFERENCE AND PRIORITY TO PATENT APPLICATIONS

This patent application claims the priority and benefit of U.S. provisional patent applications 62/549,901, 62/668,589, and 62/721,541. U.S. Provisional Application 62/549,901 is titled "Light Fixture Compatible with Standard, Commercially Available Junction Box Resulting In A Flush Mount Arrangement and Installation Method" and was filed on Aug. 24, 2017. U.S. Provisional Application 62/668,589 is titled "Flush Mount Fixture" and was filed on May 8, 2018. U.S. Provisional Application 62/721,541 is titled "Flush Mount Fixture" and was filed on Aug. 22, 2018. Provisional Patent Applications 62/549,901, 62/668,589, and 62/721,541 are herein incorporated by reference.

TECHNICAL FIELD

Embodiments are related to LED lighting, light fixtures, solid state lighting, LED lighting power supplies, and to a recessed downlight light fixture mountable into a standard, commercially available junction box resulting into a mount-flush arrangement and a method to install said fixture.

BACKGROUND

The following description of the art related to the present invention refers to a number of references including publications and patents. Discussion of such references herein is given to provide a more complete background of the principles related to the present invention and is not to be construed as an admission that such references are necessarily prior art for patentability determination purposes.

Lighting systems have been evolving at a rapid pace with moves from incandescent, fluorescent, and gas discharge to light emitting diodes (LEDs). LEDs have been improving in efficiency, thermal management, and cost. Similarly, the power supplies, a.k.a. drivers, which drive the LEDs, have seen improvements in efficiency, thermal management and cost. In general, residential and commercial lighting is transitioning to the use of LED lighting technologies.

Surface-mount and flush-mount lighting fixtures are well known devices which are used typically in commercial and residential buildings to provide both room lighting and decorative features. A surface-mount lighting fixture is defined as a light fixture which is attached to a recessed junction box extending from the finished building's ceiling. Surface-mount lighting fixtures generally do not sit flush with the plane of the ceiling.

A flush-mount lighting fixture, on the other hand, comprises all the structural and functional elements of a lighting fixture, but is typically attached to a recessed junction box and sits flush with the plane of the ceiling or any other supporting structure. Flush-mount lighting fixtures are similar to hanging light fixtures and chandeliers in that they are both coupled to the electrical system of a building through a previously installed junction box. Flush mount lighting fixtures differ from hanging lighting fixtures and chandeliers in that flush mount fixtures do not comprise cables, chains, or other attachment or hanging elements which provide an appearance of a freely-hanging fixture wherein the connection point between the fixture and the ceiling can operate as a moving, swinging or rotating element.

A junction box is a housing mounted above the ceiling plane and incorporating electrical wiring for connection to a lighting fixture as well as components for securely mounting the junction box to ceiling beams or other fixed structural building elements. Accordingly, in addition to providing the electrical power source to a lighting fixture, the lighting fixture is also securely held in place via its engagement to the junction box.

A typical recessed plenum lighting fixture is a complete housing that also requires an attached junction box or integrated electrical enclosure that must have the proper attachment ability for electrical wire electrical power feed connection(s). The recessed lighting fixture is usually mounted into a recessed ceiling plenum. The ceiling material is cut-out to allow the light fixture to recess into the ceiling plenum. The lighting fixture also may require two attached hanger bars that slide over a typically two foot wide recessed ceiling T-bar grid based upon maximum light fixture weight allowed. A recessed lighting fixture requires independent certification listing for a recessed plenum installation. The building plenum area is typically where electrical wiring is fed thru to electrical equipment.

U.S. Pat. No. 7,311,423 by Frecska et al. issued on Dec. 25, 2007 and is titled "Adjustable LED Luminaire." Frecska teaches a luminaire having multiple movable LED strips in a large fixture. It is for its teachings of LED arrays, electronics, drivers, and fixtures that U.S. Pat. No. 7,311,423 is herein incorporated by reference in its entirety.

U.S. Pat. No. 7,476,004 by Chan issued on Jan. 13, 2009 and is titled "LED Lighting Lamp Tube." Chan teaches LED arrays mounted in tubes and configured to replace fluorescent light tubes in fluorescent fixtures. Replacements such as Chan's have provided an early upgrade path for commercial lighting in the move from fluorescent to LED. It is for its teachings of LED arrays, electronics, drivers, and fixtures that U.S. Pat. No. 7,476,004 is herein incorporated by reference in its entirety.

U.S. patent application Ser. No. 13/383,917 by Burrow et al. published as US 20120113628 on May 10, 2012 and is titled "Light Emitting Diode Retrofit Conversion Kit for a Fluorescent Light Fixture." Burrow also teaches LED arrays configured to replace fluorescent light tubes in fluorescent fixtures. Replacements such as Burrow's have provided an early upgrade path for commercial lighting in the move from fluorescent to LED. It is for its teaching s of LED arrays, electronics, drivers, and fixtures that US 20120113628 is herein incorporated by reference in its entirety.

U.S. patent application Ser. No. 13/075,494 by Handsaker published as US 20120250309 on Oct. 4, 2012 and is titled "LED Lighting Fixture With Reconfigurable Light Distribution Pattern." Handsaker teaches modular LED arrays with reconfigurable lenses and a fixture with an extruded aluminum base. It is for its teachings of LED arrays, electronics, drivers, and fixtures that US 20120250309 is herein incorporated by reference in its entirety.

U.S. patent application Ser. No. 13/473,929 by Araki, et al. published as US 20120320627 on Dec. 20, 2012 and is titled "Flat Panel Lighting Device and Driving Circuitry." Araki teaches modular LED arrays and drivers configured in a relatively thin flat frame that can be edge lit. It is for its teachings of LED arrays, electronics, drivers, and fixtures that US 20120320627 is herein incorporated by reference in its entirety.

U.S. patent application Ser. No. 14/210,991 by Ishii published as US 20150016100 on Jan. 15, 2015 and is titled "Luminaire." Ishii teaches a fixture having an LED array and drivers with a long lens covering the electronic components.

It is for its teachings of LED arrays, electronics, drivers, and fixtures that US 20150016100 is herein incorporated by reference in its entirety.

Current light emitting diode (LED) downlights are designed to fit in legacy luminaires such as a 6-inch housing. For new construction, that requires the contractor to install large and expensive housings, which must be oversized for the LED retrofits that are to be installed. In addition, if a fire rating is needed, the arrangement must include additional coverings or specialized housings, thus adding additional cost to the system.

As can be inferred by this background section, the prior art discloses luminaires and lighting fixtures that can be used commercially, but that the overall packaging, fixtures, drivers, interconnects, and designs are still evolving. Systems and methods that provide LED lighting with advanced packaging, fixtures, drivers, interconnects, and designs are needed.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

A main objective of the present invention is miniaturizing the LED driver design by providing a downlight lighting fixture with components arranged in such a manner that there is no need for a 6-inch typical housing or a specialized fire-rated housing. The downlight lighting fixture of the embodiments can be installed into a 4-inch non-metallic junction box or a 4" octagon metal junction box. Certain embodiments also fit into 3" and 3½" junction boxes.

Other objectives of the present invention are to provide a downlight lighting fixture which does not require: (1) an attached junction box or integral electrical enclosure that must have the proper attachment ability for electrical wire electrical power feed connection(s), which is possible because the unit mounts directly into an existing low cost pre-wired recessed junction box; (2) a ceiling tile cut-out to allow light fixture to be recessed into the ceiling plenum because the light fixture mounts directly into an existing low cost pre-wired recessed junction box; (3) hanger bars or any additional fasteners used to install and secure light fixtures because the unit mounts into an existing recessed pre-wired low cost junction box and weighs less than the weight required to have added hanger bars; and (4) a costlier independent certification approval for recessed plenum applications because the unit mounts directly into an existing low cost pre-wired recessed junction box. Therefore, the present invention greatly reduces cost of the light fixture itself and reduces labor requirements to install it.

U.S. Pat. No. 4,829,410 to Patel, et al. (hereinafter Patel), describes and claims a typical ceiling mounted luminaire housing system. Patel illustrates some of the most salient differences between the traditional ceiling mounted light fixture and claimed embodiments. For example, Patel requires the following elements that are not required for the installation and safe operation of the claimed embodiments, as set forth in FIGS. 1 and 2 of Patel: (11) luminaire housing system, (13) rectangular shaped mounting plate, (17) generally cylindrical lamp housing, (27) junction box, (33) flexible metal conduit, (49) raceway, (51) pair of mounting bars, (53) raceway, and (55) pair of mounting bars. Obviating with numerous elements required by the ceiling mounted light fixtures of the prior art constitutes a substantial advance over the prior art.

Other important objectives that the present invention seeks and reaches are: the minimization of the recess depth; routing heat out through a metal flange; and high efficiency thus leading to lower heat generation.

It is therefore an aspect of the embodiments to have a housing. The housing has a housing inside, a housing top surface, mounting holes, clip fastener holes, and a closed cylindrical section. The housing inside is inside the closed cylindrical section and can be access through the bottom the closed cylindrical section, which is open, while the top of the closed cylindrical section is closed by a housing top. The outside surface of the housing top is the housing top surface. The mounting holes are configured for mounting the embodiments to a junction box such as a four inch junction box. The clip fastener holes are configured for the attachment of clips by fasteners, such as rivets. The housing can have circular symmetry such that the housing is symmetric around a housing axis of rotation.

A driver board can be attached to the housing top surface. The circuit board can be single sided when the electrical components are chosen carefully based on the embodiment's design objectives. The single side circuit board has one side populated with the electrical components and the other side blank. The blank side of the driver board can be set directly on the housing top surface without fear of short circuiting because the blank side is blank. Note that heat sink compound or a similar layer of heat conducting soft/pasty material can improve heat transmission between the driver and the housing.

It is another aspect of the embodiments that a trim can be removably attached to the housing. The trim has a trim rim, a trim flat, a narrowing section, and a widening section. The trim can be circularly symmetric around a trim axis of rotation. When attached to the housing, the trim axis of rotation and the housing axis of rotation can be the same axis of rotation. The trim can be a unitary piece. For example, the trim can be stamped from a single piece of aluminum or molded as a single piece. The trim rim can surround the trim flat that in turn surrounds the narrowing section. The narrowing section can extend upward from the trim flat while the widening flange extends upward from the narrowing section.

It is yet another aspect of the embodiments that clips removable attach the trim to the housing. The clips are attached inside the closed cylindrical section of the housing and can be held in place by fasteners that pass through the clip fastener holes. Alternative attachment means such as adhesives, soldering, or welds can hold the clips in place such that the clip fastener holes are not needed. The trim can be attached to the housing by pushing the widening flange into the housing inside until the clips engage and hold the trim in place.

It is still yet another aspect of the embodiments that a light engine produces light that shines out the bottom of the lighting fixture. Note that "bottom" is used here to indicate the bottom of a ceiling mounted light fixture but is not intended to limit the light fixture to one mounting orientation.

The light engine includes the driver board, discussed above, a LED array, an array cover, a reflector, and a lens. The lens can be a frosted diffusor that transmits light but obscures a direct view of the LED array. The lens is attached to the trim by lens tabs (or frosted diffusor tabs) such that the light from the LED array can exit the fixture by passing through the lens. The LED array and the array cover are positioned inside the closed cylindrical surface and can be attached to the housing top such that light emitted by the LED array passes through the array cover before passing through the lens and thereby exiting the light fixture.

The array cover can be a single piece of material such as glass or polycarbonate. When polycarbonate, the array cover must be at least 2.5 mm thick although testing has revealed that a 3 mm thickness provides even better results in fire safety testing. A polycarbonate or other plastic array cover can be formed into or as a "hat" shape with a rim and a central dome. The central dome is sized such that the LED array's LED diodes fit within a hollow between the central dome and the LED array.

It is a further aspect of the embodiments that a fastener, such as a screw can pass through holes in the array cover, LED array, housing top, and driver board to thereby attach the array cover, LED array, and driver board to the housing. Many embodiments have the driver board above the housing top while the LED array and array cover are below the housing top. A screw type fastener must be threaded into a threaded component in order to operate as a fastener. The threaded component can be the array cover, driver board, a suitable positioned bolt, or some other device.

The driver board and the LED array can be electrically connected by wiring passing through a wiring hole in the housing, typically the housing top, such that the driver can supply electrical power to the LED array.

The reflector is cone shaped and configured to reflect LED light out of the light fixture. The narrow end of the cone can fit over the central dome of an array cover while the wide end of the reflector rests against the lens. In such embodiments, the lens and array cover hold the reflector in position within the fixture.

It is a yet further aspect of the embodiments that a cover covers the driver board. The cover can be cylindrically shaped, as in FIGS. 1-4, with a closed end and an open end. The open end is the cover bottom. The cover is closed above, the closed end, by a flat top surface. The cover can be attached to the housing, over the driver board, and can have an opening for feeding electric power into the lighting fixture. Considering the design goals, the flat top surface should be within 1.3 inches of the trim flat when the cover and the trim flat are properly installed.

The embodiments can include: (1) three push in quick connectors (3 or 4 port) on pigtail for line voltage so that the push connectors fit 12 American Wire Gauge units; (2) compatibility with most commercially available dimmers so flickering is minimized or eliminated; (3) compliance with all listed product requirements of Underwriter Laboratories standards 1598 and 8750; and (4) compliance with all Energy Star requirements.

A trim engagement means can provide a light fixture installer the ability to easily swap the trim with alternative colored and shaped trims through the housing's snap-lock means (e.g. the clips that hold the trim) and the corresponding mating means of the metal trim (e.g. the trim's narrowing section and widening flange). The trim can be made out of metal and can have a 120 mm diameter to accommodate faster installation. The trim, when installed, can be flush to the ceiling. The LEDs can be high efficiency mid-power. The lens can be frosted so the LEDs are hidden from view as much as possible and the lens tabs can be invisible to the eye when the lens and trim are installed. A design goal of the embodiments is minimize the size of the housing and cover so as to maximize wiring volume in the device's box (e.g. junction box).

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
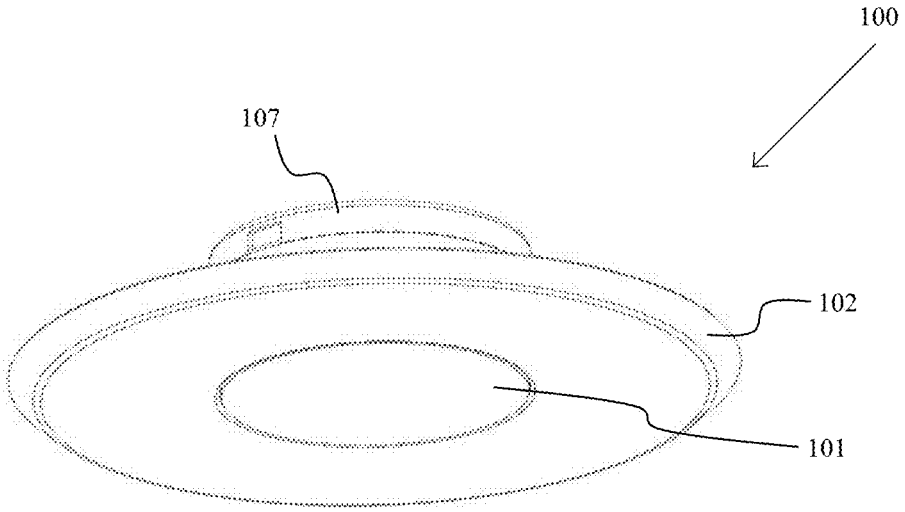
FIG. 1 illustrates a lighting fixture viewed from below in accordance with aspects of the embodiments.

The particular values and configurations discussed in these non-limiting examples can be varied and are cited merely to illustrate at least one embodiment and are not intended to limit the scope thereof.

For a general understanding of the present disclosure, reference is made to the drawings. In the drawings, like reference numerals have been used throughout to designate identical elements.

Figure 2:
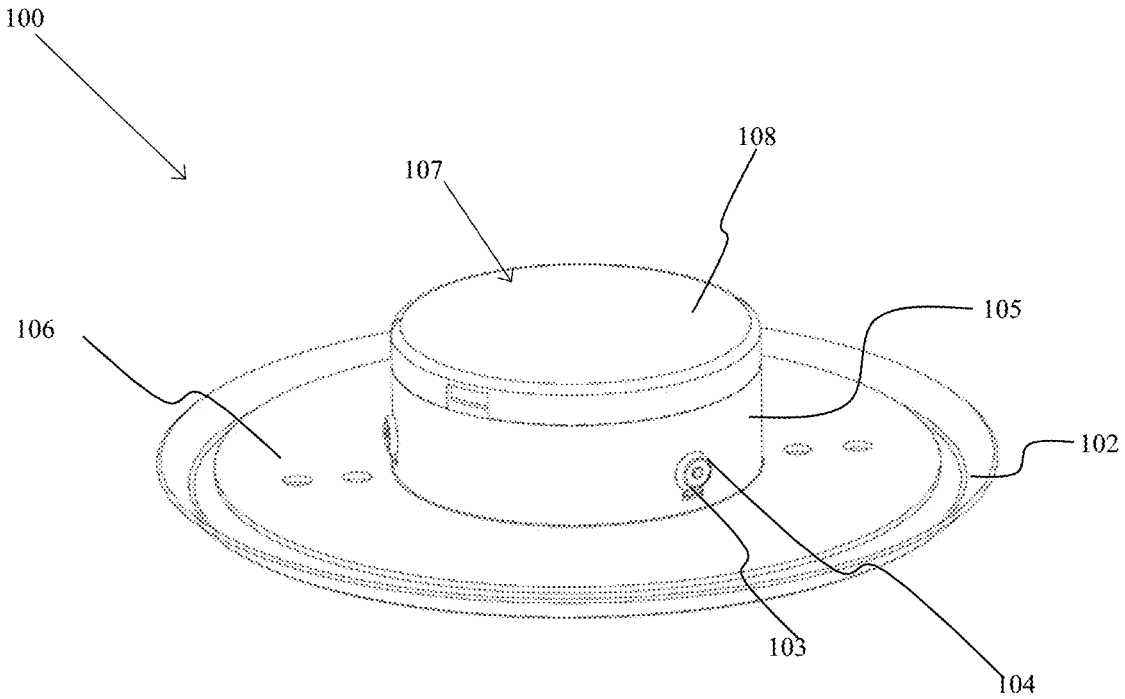
FIG. 2 illustrates a lighting fixture viewed from above in accordance with aspects of the embodiments.

FIGS. 1-2 illustrate a lighting fixture 100 viewed from below and above, respectively, in accordance with aspects of the embodiments. The lens 101 is attached to the trim 102. The trim 102 is held to the housing 106 by clips 103 attached by fasteners 104 inside the closed cylindrical section 105 of the housing 106. The closed cylindrical section is closed on the top and open on the bottom. The trim 102, clips 103, and housing 106 are configured such that the housing 106 can be attached to a ceiling, junction box, or other location using the housing's mounting holes 113. The mounting holes can be sized and positioned for attaching housing directly to a junction box. The trim 102, with lens 101 installed, can then be pressed into position as shown in FIGS. 1-2. A cover 107 can attach to the back of the housing 106 to cover the driver board 111. As shown, the cover 107 is circular, attaches to the end of the closed cylindrical section 105 of the housing 106, is sized to have a diameter within 5% of the diameter of the closed cylindrical section 105, and can have a flat top surface 108.

Figure 3:
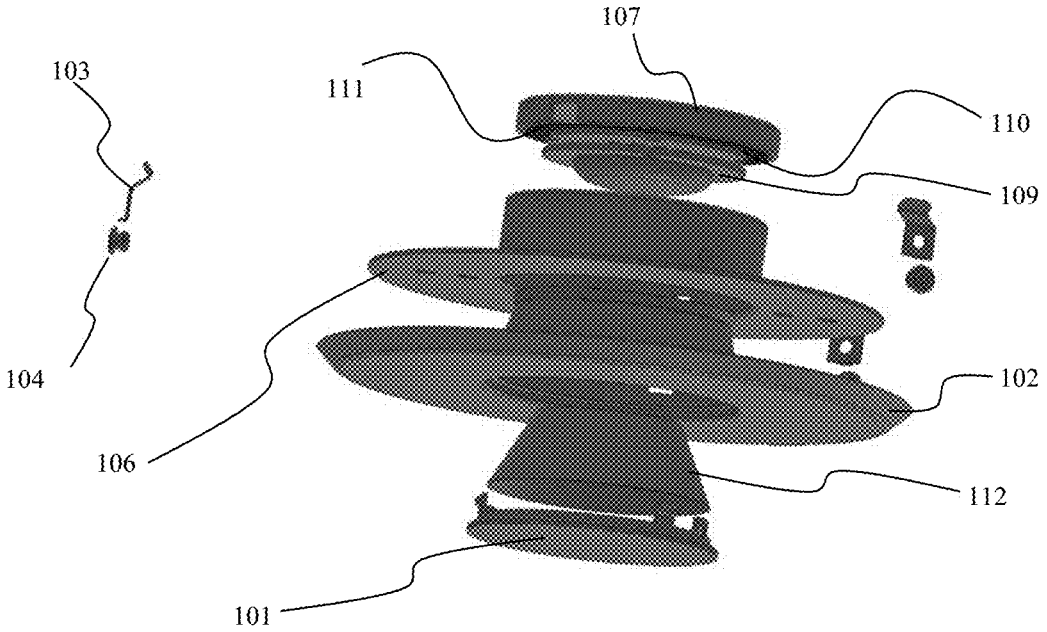
FIG. 3 illustrates an exploded view of the fixture of FIGS. 1-2 in accordance with aspects of the embodiments.
Figure 4:
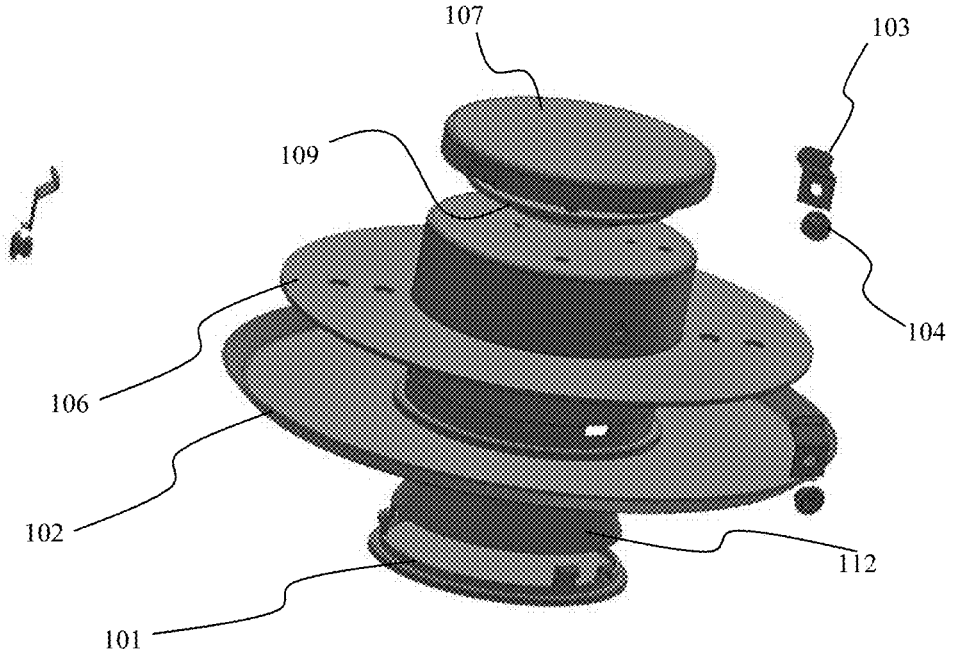
FIG. 4 illustrates another exploded view of the fixture of FIGS. 1-2 in accordance with aspects of the embodiments.

FIGS. 3-4 illustrate exploded views of the lighting fixture 100 of FIGS. 1-2 in accordance with aspects of the embodiments. The cover 107 covers the driver board 111 that is attached to the top of and outside of the closed cylindrical section 105 of the housing 106. The LED array 110 and array cover 109, pictured outside the housing 106 for clarity, are attached to top of and—inside—the closed cylindrical section 105 of the housing 106. Similarly, the clips 103 are shown outside the housing 106 whereas they are actually attached to the inside of the housing 106 by the fasteners 104. The reflector 112 is configured to be located between the lens 101 and the array cover 109. The illustrated fasteners 104 are rivets although other fasteners (screws/bolts) or attachment means (glue, weld, solder, etc.) can be used.

Figure 5:
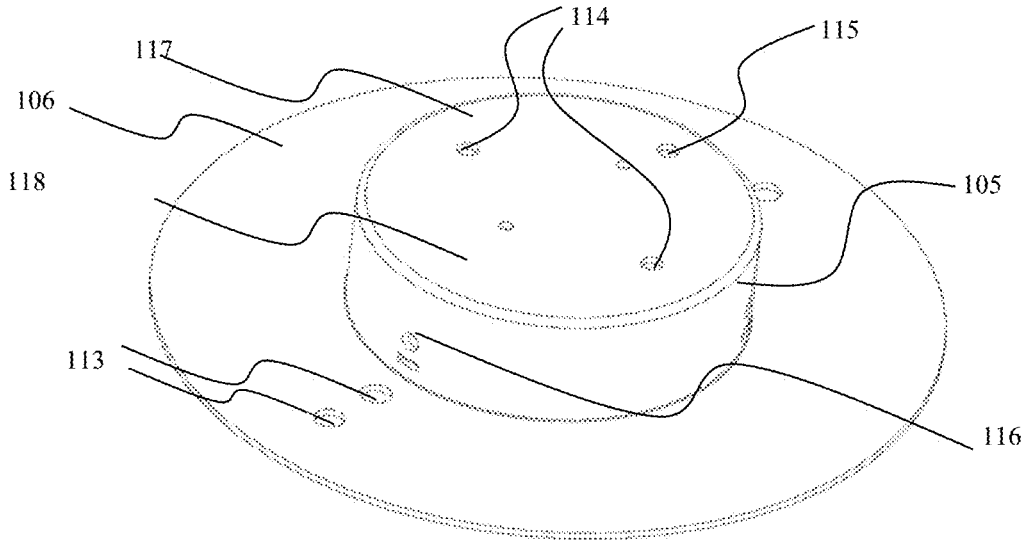
FIG. 5 illustrates a housing viewed from above in accordance with aspects of the embodiments.
Figure 6:
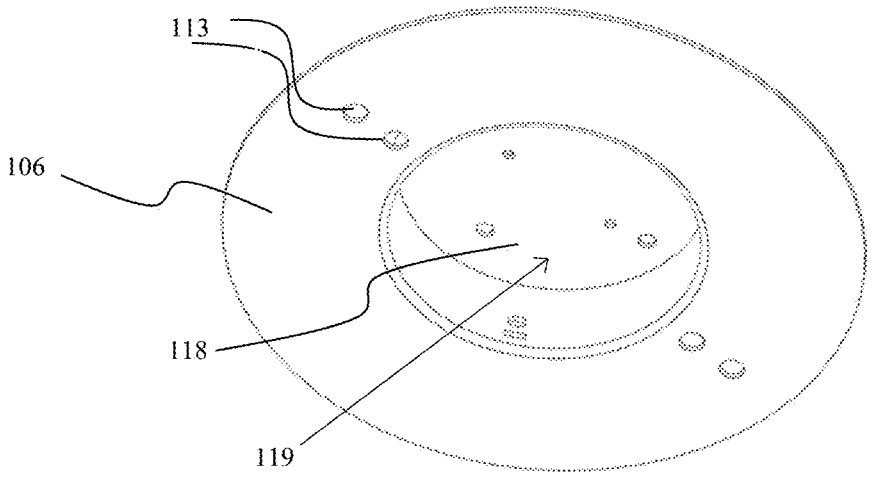
FIG. 6 illustrates a housing viewed from below in accordance with aspects of the embodiments.

FIGS. 5-6 illustrates a housing 106 viewed from above and below, respectively, in accordance with aspects of the embodiments. The driver board 111, LED array 110, and array cover 109 can be attached to the housing 106 by, for example, screws passing through the array attach holes 114. The screws can be threaded into the array cover 109 if it is so configured or can be threaded into nuts. The nuts can be positioned inside the housing 106 and under the array cover 109 or can be positioned outside the housing 106 and above the driver board 111. Wiring can pass electric power from the driver board 111 outside the housing 106 through a wiring hole 115 and to the LED array 110 inside the housing 106. The clips 103 being illustrated as attached by rivets, the housing 106 has clip fastener hole 116*s*, a.k.a. rivet holes, such that the clips 103 can be held inside the housing 106.

The illustrated housing 106 has a housing rim and a closed cylindrical section 105. The closed cylindrical section 105 is closed on top by the housing top 118 and is open below such that the housing inside 119 can be accessed from the bottom of the housing 106. When single sided, the driver board 111 can be positioned directly on the housing top surface 117 which is the outside surface of the housing top 118.

Figure 7:
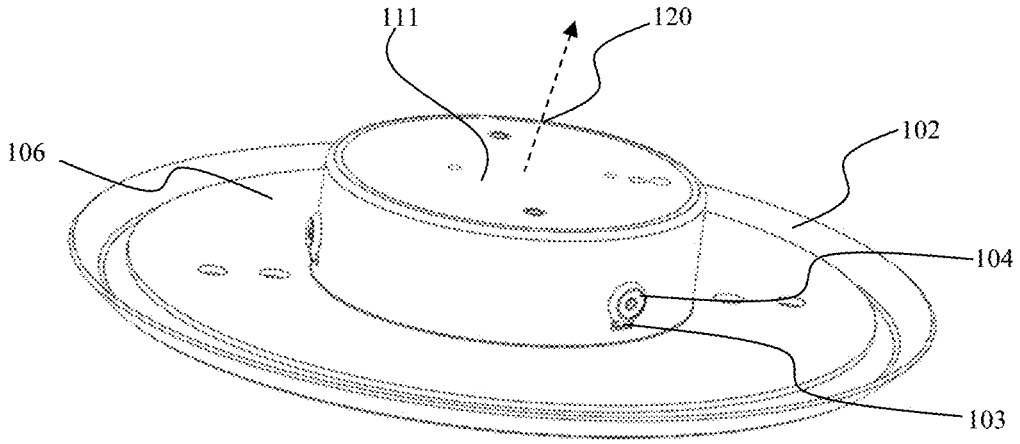
FIG. 7 illustrates a fixtures trim snapped into its housing in accordance with aspects of the embodiments.

FIG. 7 illustrates a fixture's trim 102 snapped into its housing 106 in accordance with aspects of the embodiments. The rivets, labeled "fastener" can be seen attaching the clips 103 inside the housing 106. The trim 102 has been pressed into the housing 106 such that the clips 103 engage the widening flange 123 of the trim 102. This engagement holds the trim 102 to the housing 106. The housing 106, shown having circular symmetry, has an axis of rotation here called the housing axis of rotation 120. The housing 106 and its closed cylindrical section 105 share the same axis of rotation. The driver board 111 is shown in position on the housing top surface 117.

Figure 8:
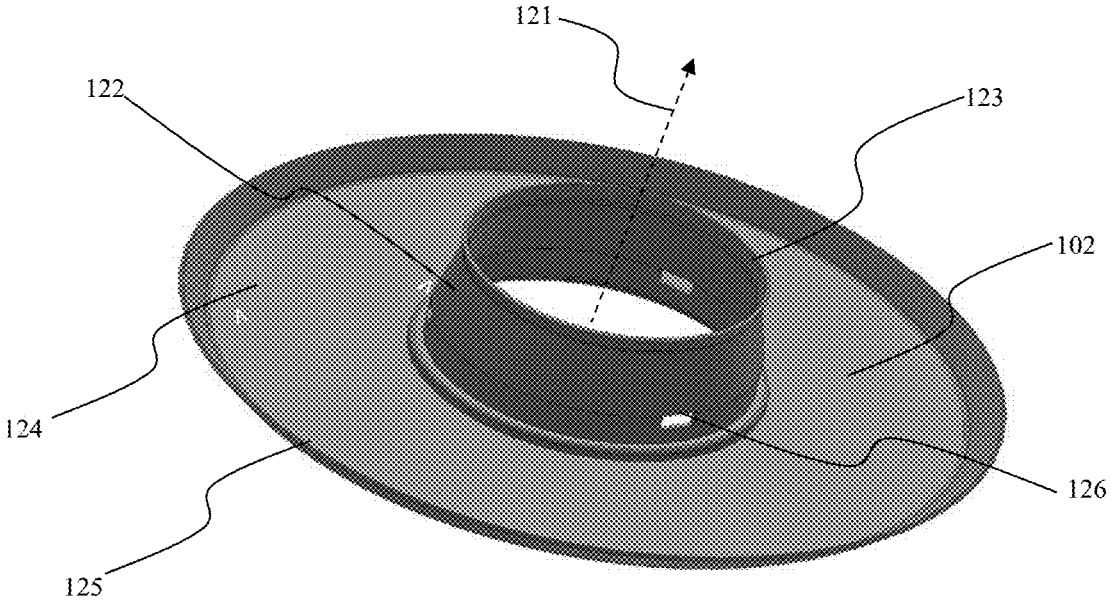
FIG. 8 illustrates trim viewed from above in accordance with aspects of the embodiments.

FIG. 8 illustrates trim 102 viewed from above in accordance with aspects of the embodiments. The trim 102, also shown having circular symmetry, has an axis of rotation, called the trim axis of rotation 121. The trim 102 is a single piece, either formed as unit or permanently joined to form a unit. The trim 102 has a trim rim 125, trim flat 124, narrowing section 122, and widening flange 123. The trim rim 125, trim flat 124, narrowing section 122, and widening flange 123 are also circular and have the same axis of rotation as the trim 102 itself.

Circular elements, aka circularly symmetric element, have an axis of rotation meaning that they are symmetric about an axis of rotation. Those practiced in the physical design arts realize that such circular symmetry is generally descriptive of the shape of an element that may also contain holes and other features pressed into or molded into the otherwise circularly symmetric element. For example, the illustrated circularly symmetric trim 102 has lens gaps 126 that are not circularly symmetric.

Figure 9:
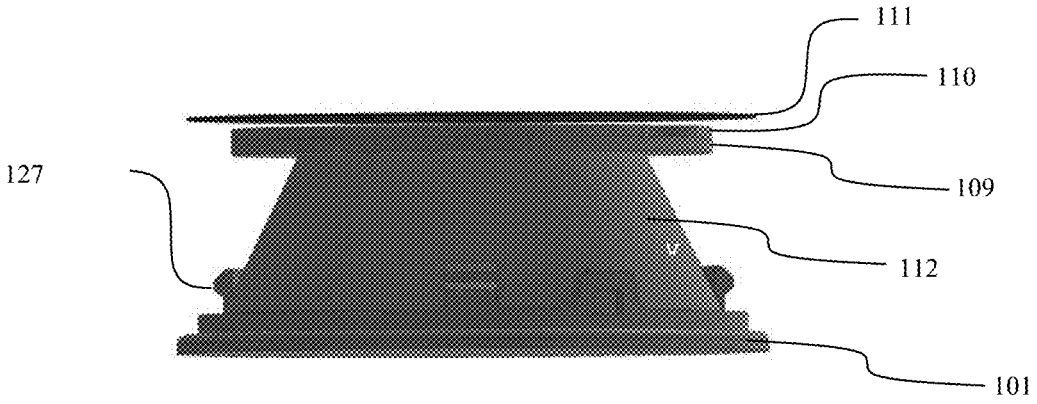
FIG. 9 illustrates a light engine in accordance with aspects of the embodiments.
Figure 10:
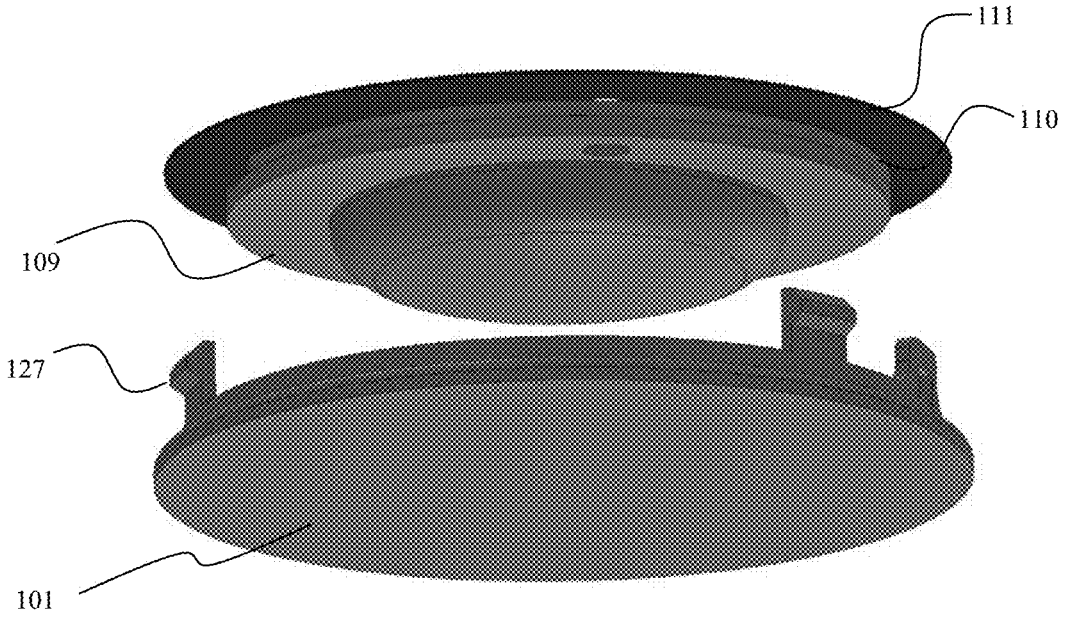
FIG. 10 illustrates a light engine with its reflector removed in accordance with aspects of the embodiments.

FIGS. 9-10 illustrate a light engine in accordance with aspects of the embodiments. FIG. 10 has the reflector removed to provide a better view of the array cover 109. The driver board 111 can accept unconditioned electric power such as a facility's mains power (e.g. 120 VAC, 220 VAC) and can produce conditioned electric power for use by the LED array 110. In general, LED arrays require constant current DC electric power. The LED array 110, having a number of LEDs (light emitting diodes) receives the conditioned electric power and produces LED light that shines down through the array cover 109 and out the lens 101. A reflector 112 catches stray light and directs it out the lens 101.

Figure 11:
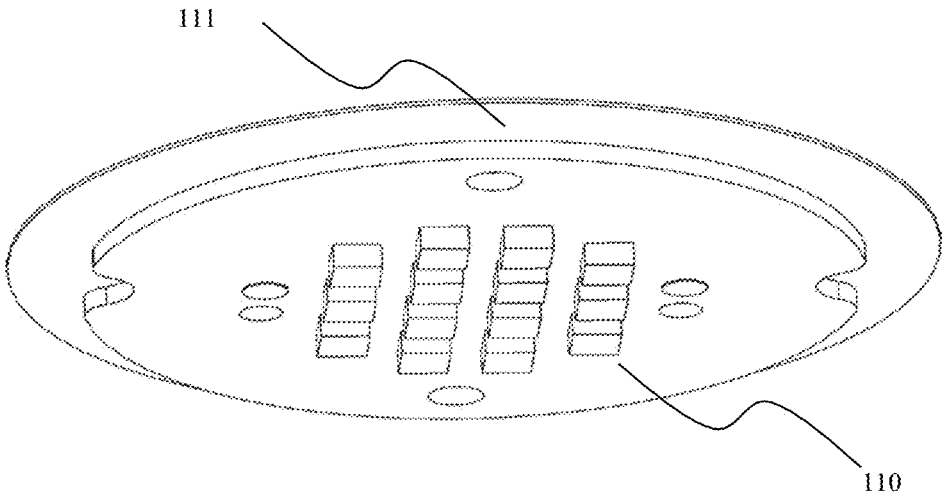
FIG. 11 illustrates a driver board and an LED array in accordance with aspects of the embodiments.

FIG. 11 illustrates a driver board 111 and an LED array 110 in accordance with aspects of the embodiments. The individual LEDs on the LED array 110 are visible. The driver board 111 has a single sided circuit board. A single sided circuit board has wiring traces on only one side and none internally. As such, single sided circuit board can be produced very economically. The driver board's electronic components (chips, resistors, capacitors, indictors, etc.) are all attached to the side of the board having the traces, called the populated side. The populated side faces away from the housing 106 to which the driver board 111 is attached. As such, the unpopulated side of the driver board 111 can rest flatly on the housing 106. Similar to the driver board 111, the LED array 110 may have components, mostly LEDs, on one side although it may have numerous layers and levels of wiring traces. As such, the LED array 110 has a flat unpopulated side that can rest flatly against the surface of the housing 106, this time an inside surface.

Figure 12:
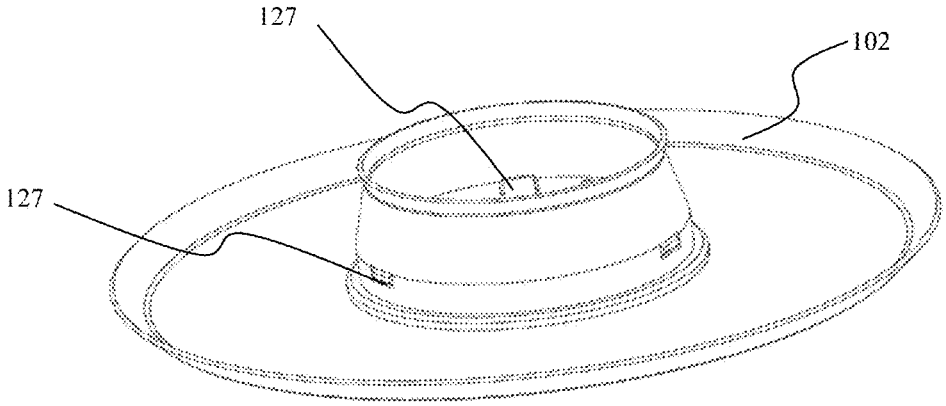
FIG. 12 illustrates the lens attached to the trim in accordance with aspects of the embodiments.
Figure 13:
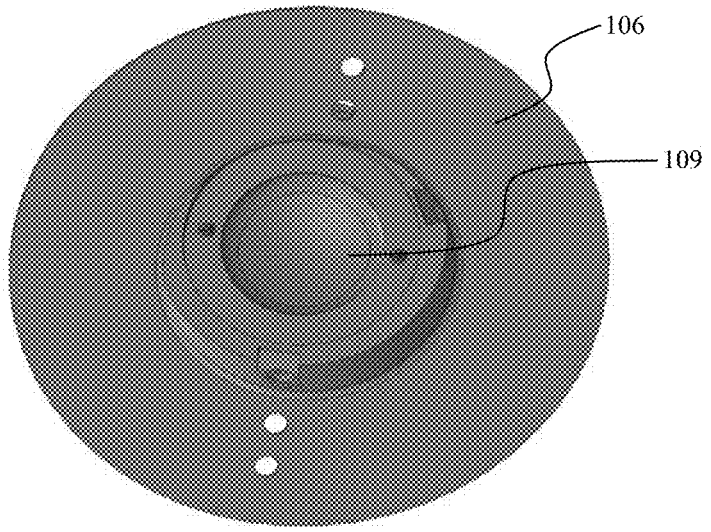
FIG. 13 illustrates the array cover inside the housing in accordance with aspects of the embodiments.

FIG. 12 illustrates the lens 101 attached to the trim 102 in accordance with aspects of the embodiments. The lens 101 has been pressed into the trim 102 such that the lens tabs 127 of the lens 101 line up with and snap into the lens gaps 126 of the trim 102. A person pulling the trim 102 from the fixture could look into the housing 106 and observe the array cover 109, as illustrated in FIG. 13.

Figure 14:
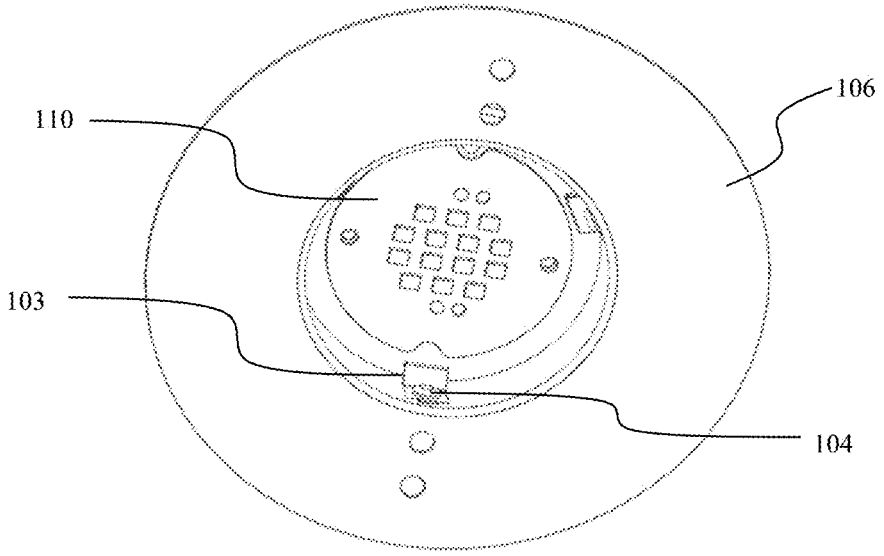
FIG. 14 illustrates the LED array inside the housing in accordance with aspects of the embodiments.

FIG. 14 illustrates the LED array 110 inside the housing 106 in accordance with aspects of the embodiments. Here the array cover 109 has been removed. Removing the array cover 109 is more complicated than removing the trim 102 because the trim 102 can be pulled free whereas the array cover 109 is located inside the housing 106 at the top of the cylindrical section and is likely attached by threaded fasters that must be located and turned.

Figure 15:
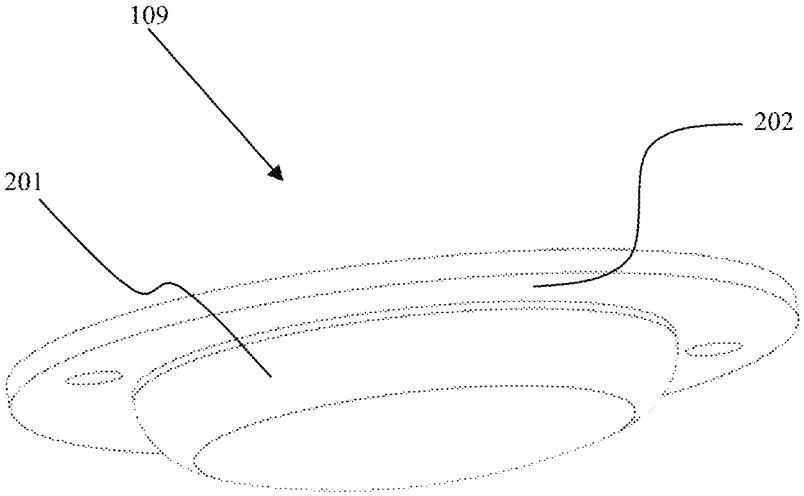
FIG. 15 illustrates an array cover in accordance with aspects of the embodiments.

FIG. 15 illustrates an array cover 109 in accordance with aspects of the embodiments. The illustrated array cover is hat shaped with a rim 202 and a central dome 201. As can be seen, the array cover 109 is a circular element with two holes for attachment to the LED array 110 and housing 106. The central dome is hollow to make room for the LEDs on the populated side of the LED array 110. The array cover 109 can be transparent to maximize light transmission. Light passing through the array cover 109 can also pass through the lens 101. The lens 101 is typically a diffusing lens. The array cover can have a specified thickness, such as 2.5 mm, 3 mm, at least 3 mm, etc. The specified thickness is the thickness of the material.

The sizes, shapes, materials, and designs of the various parts of the light fixture are the result of careful and iterative design to meet certain design goals. For example, the thickness of the array cover provides for cost efficient production while also providing for fire safety when the lighting fixture is mounted in a non-metallic junction box. Those practiced in building codes realize that "fire safety" means meeting certain building codes and/or passing specific tests such as those performed by Underwriter's Laboratories.

The figures illustrate two variations of the lighting fixture with FIGS. 1-15 primarily drawn to an advanced version and with FIGS. 16-23 drawn to an earlier version. The two versions are similar in most respects excepting for the driver and the cover. The earlier version has a larger driver that is mounted toward the side of the housing instead of being disposed on the outside surface of the housing top. The cover of the earlier version covered the driver in its side mounted position and extended over the outside surface of the housing top. Excepting for the driver and the cover, the two versions are substantially the same. Both versions of the light fixture are mountable into a standard, commercially available junction box resulting into a mount-flush arrangement and a method to install said fixture.

A typical prior art light fixture has a complete housing unit including an attached junction box or integrated electrical enclosure. The electrical enclosure has attachments for electrical wire electrical power feed connections. The prior art light fixtures are typically mounted into a recessed ceiling plenum with the ceiling material being cut-out to create an opening that allows the light fixture to recess into the ceiling plenum. The installation usually requires at least two attached hanger bars that slide over a typical 2' wide recessed ceiling T-bar grid based upon the maximum light fixture weight allowed. The prior art light fixture requires independent certification listing for a recessed plenum installation. The building plenum area is typically where electrical wiring is fed thru to electrical equipment.

Figure 16:
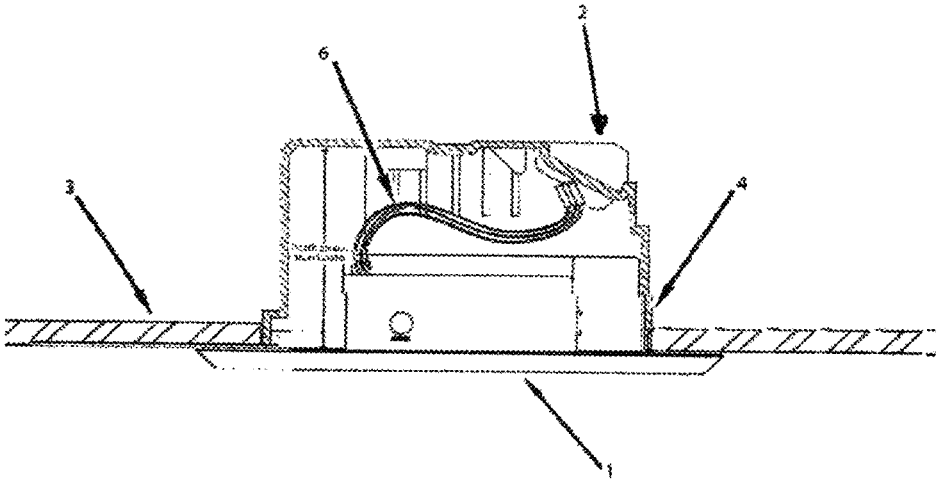
FIG. 16 illustrates an overall schematic frontal cut view of a side driver embodiment and shows a ceiling cut out opening, a junction box and electrical power wires, and trim fitting flush to the ceiling without the need of additional fasteners, in accordance with aspects of the embodiments.

Referring now to FIG. 16, contrary to the prior art flush-mounted light fixtures, the light fixture embodiments disclosed and claimed herein do not require an attached junction box or integral electrical enclosure that must have the proper attachment ability for electrical wire electrical power feed connection(s), because light fixture 1 mounts directly into an existing low cost pre-wired recessed junction box 2. FIG. 16 also illustrates the ceiling tile cut-out 3 which allows the light fixture 1 to be recessed into the ceiling plenum 4. The superior arrangement is possible because the light fixture 1 now mounts directly into an existing low cost pre-wired recessed junction box 2.

Unlike the flush-mounted light fixtures of the prior art, the light fixture 1 of the disclosed embodiments does not require hanger bars because it mounts into an existing recessed pre-wired low cost junction box 2 and does not exceed the maximum weight load that would have required added hanger bars. The careful and detail oriented design and selection of the elements of the disclosed embodiments provides for directly mounting into the existing, low-cost, pre-wired recessed junction box and thereby obviates the costly independent certification approval for recessed plenum applications.

The embodiments are mounted into the recessed junction box 2 and electronically wired to existing electrical power wires 6 that extend into the junction box 2. That capability of the embodiments eliminates the prior art's requirement that junction boxes or electrical enclosure be part of and mounted to the light fixtures themselves. The functional and structural features of the disclosed embodiments greatly reduce the cost of manufacture of the light fixture and reduces labor, when compared to the prior art, because the embodiment is mounted directly into an existing low cost off-the shelf j-box with no extra fasteners.

Figure 17:
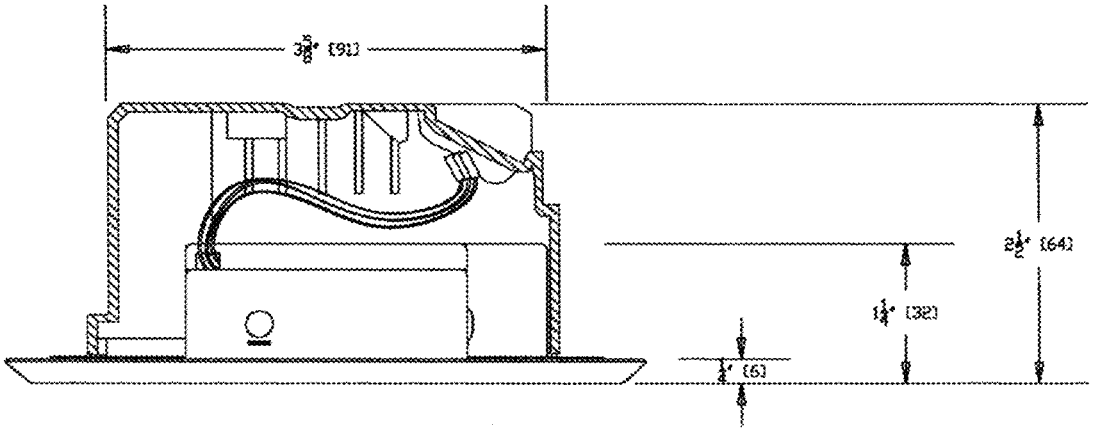
FIG. 17 illustrates a dimensioned view of a side driver embodiment inside a cut view of a junction box in accordance with aspects of the embodiments.
Figure 18:
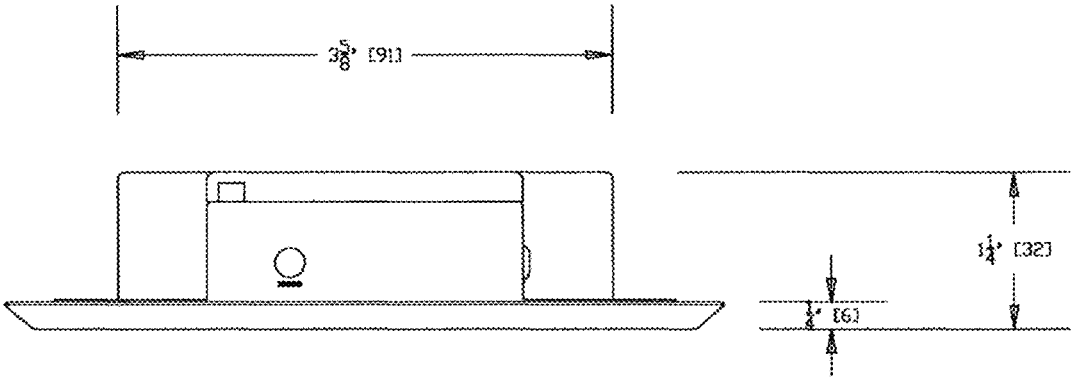
FIG. 18 illustrates another dimensioned view of the side driver embodiment of FIG. 17 in accordance with aspects of the embodiments.

As illustrated in FIGS. 17 and 18, the embodiments have specific dimensional requirements for installation.

Figure 19:
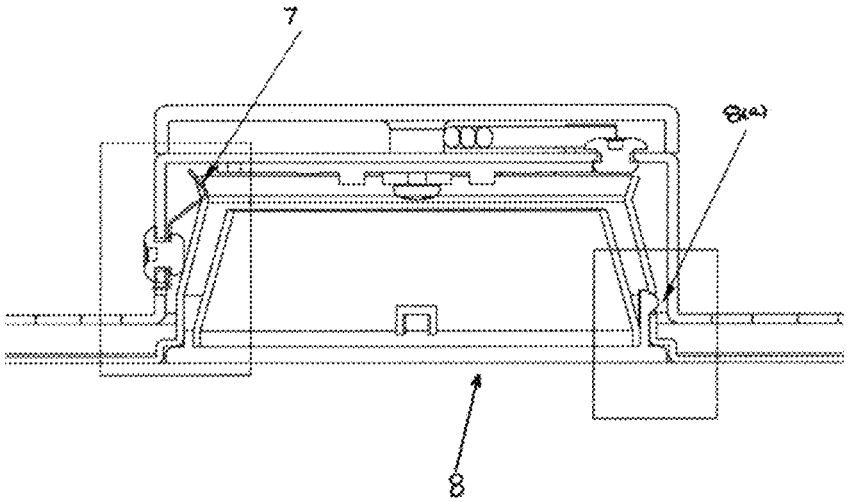
FIG. 19 illustrates a cut view of the side driver embodiment of FIG. 17 showing the trim engagement means and a frosted lens with lens tabs in accordance with aspects of the embodiments.

As depicted in FIG. 19, the trim engagement means 7 (specifically the clips 103 and trim 102) is a snap lock-type engagement that allows the trim 11 to firmly and mechanically engage to the fixture housing 2. FIG. 19 also illustrates the relative positions and structural relationship between the lens 8 and the lens tabs 8*a*.

Figure 20:
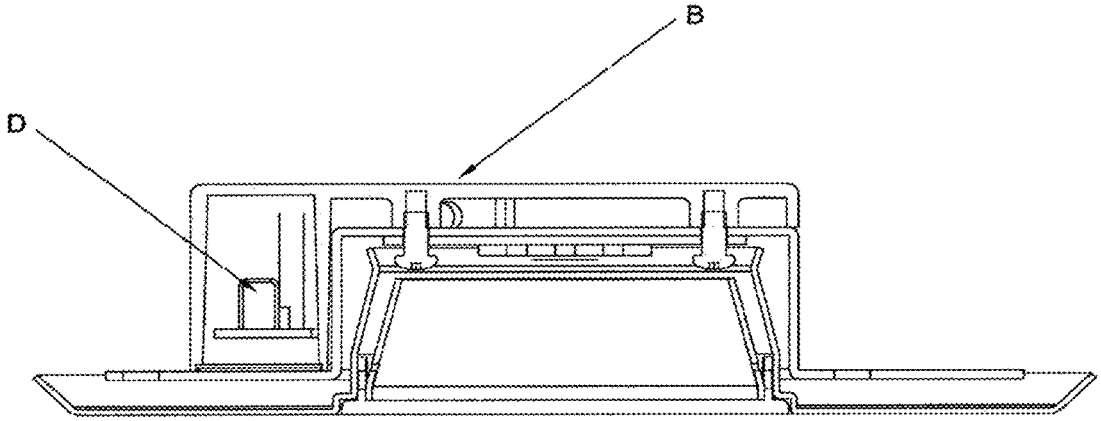
FIG. 20 illustrates a cut view of the side driver embodiment of FIG. 17 showing the driver and the cover in accordance with aspects of the embodiments.
Figure 21:
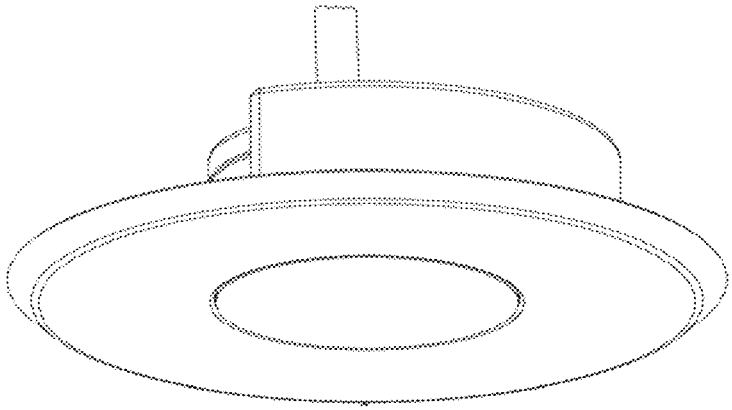
FIG. 21 illustrates a perspective view of the side driver embodiment of FIG. 17 fully assembled in accordance with aspects of the embodiments.
Figure 22:
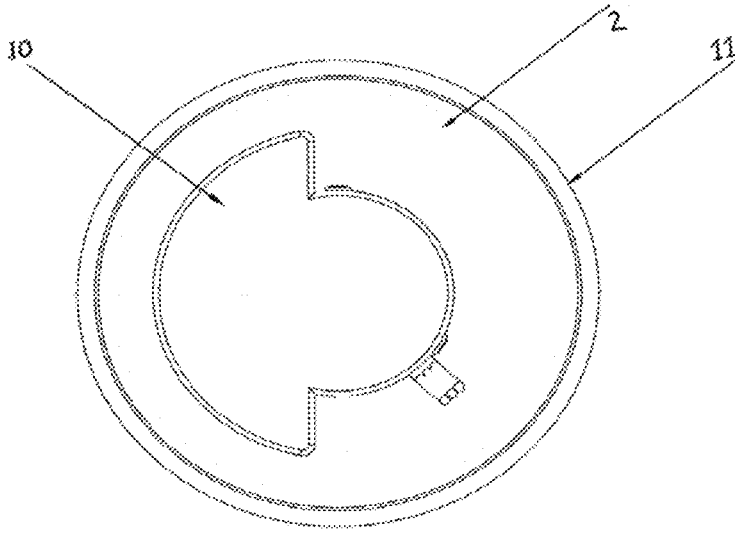
FIG. 22 illustrates a top view of the side driver embodiment of FIG. 17 and shows the interrelation and fit between the housing, the cover, and the trim in accordance with aspects of the embodiments.

FIG. 20 shows the relative position and configuration of the side mounted driver 9 which is firmly and mechanically attached to the inside of the side mounted driver cover 10. FIG. 21 provides a perspective view of a previous version embodiment with side mounted driver, the embodiment being fully assembled As depicted in FIG. 22, the housing 2, driver cover 10 and the trim 11 are assembled to result in a tightly engaged single structure that fits flush to the ceiling in the assembled and installed light fixture of the embodiments.

Figure 23:
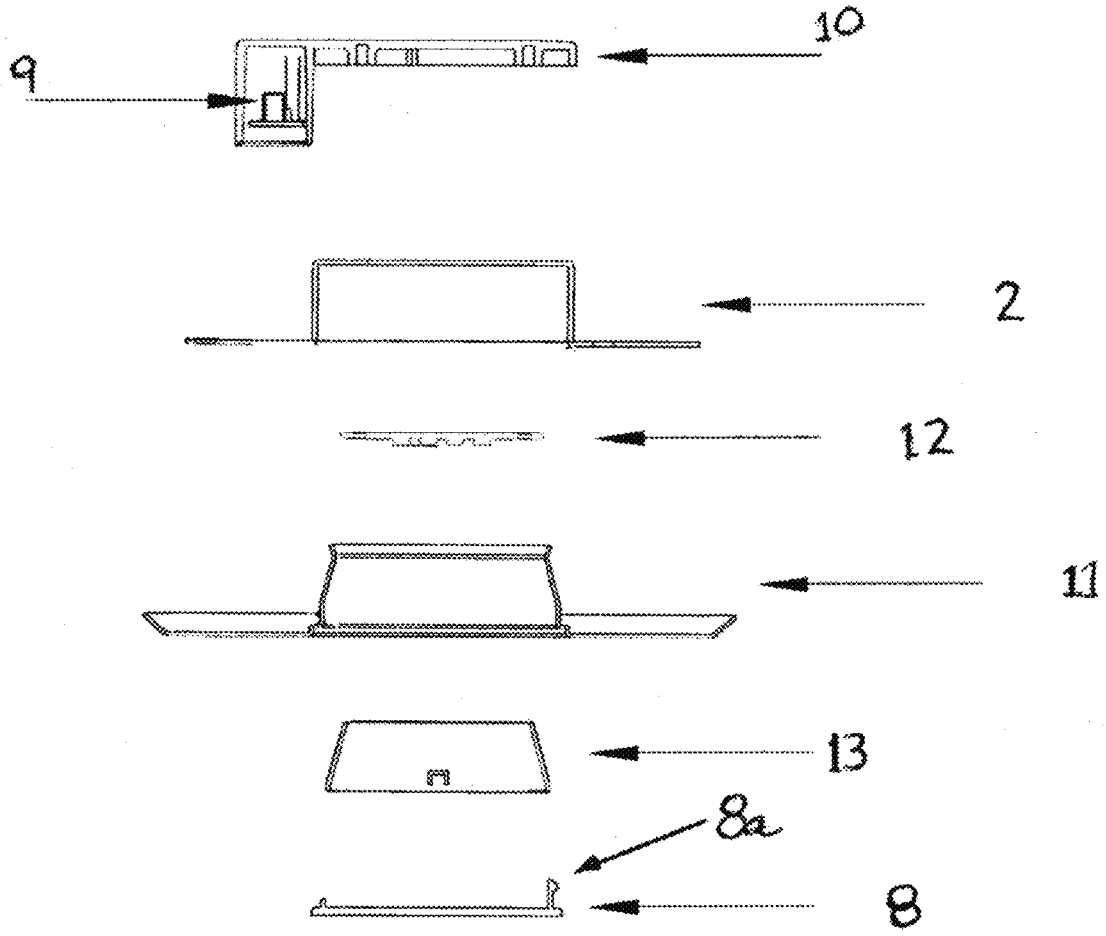
FIG. 23 illustrates several elements of the of the side driver embodiment of FIG. 17 that is shown disassembled into discrete elements in accordance with aspects of the embodiments.

For ease of understanding of the structural features and interrelation of the elements of the embodiments, FIG. 23 illustrates five of several elements in a disassembled, individual form, including the driver 9 and driver cover 10; the housing 2; the LED array 12; the trim 11; the internal reflector 13; and the lens 8 comprising lens tabs 8*a*.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A lighting fixture comprising:

a housing comprising a housing inside, a housing top surface, a plurality of mounting holes, a plurality of array attach holes, a plurality of clip fastener holes, and a closed cylindrical section, wherein the housing has circular symmetry around a housing axis of rotation, and wherein the housing inside is within the closed cylindrical section;

a driver board attached to the housing top surface, wherein the driver board comprises a circuit board and at least one electrical component, wherein the circuit board is single sided and comprises a populated side and a blank side, wherein the at least one electrical component is mounted on the populated side, and wherein the blank side is closer to the housing than the populated side;

a trim comprising a trim rim, a trim flat, a narrowing section, and a widening flange, wherein the trim has circular symmetry around the housing axis of rotation, wherein the trim is a unitary piece, wherein the trim rim surrounds the trim flat, wherein the trim flat surround the narrowing section, wherein the narrowing section extends in an upward direction from the trim flat, and wherein the widening flange extends upward from the narrowing section;

a plurality of clips attached inside of the closed cylindrical section and configured to releasably hold the widening flange within the housing inside; and a light engine comprising the driver board, a LED array, an array cover, a reflector, and a lens, wherein the LED array and array cover are attached to the housing and inside the housing and configured such that light from the LED array passed through the array cover and thence from the housing, wherein the reflector is cone shaped and configured to reflect LED light out of the housing, wherein the lens is attached to the trim by a plurality of lens tabs, wherein the light engine is configured to shine LED light through the lens and out of the lighting fixture, wherein the array cover is a single piece of polycarbonate that is at least 2.5 mm thick.

2. The lighting fixture of claim 1 wherein at least one screw passes through a plurality of holes in the driver board, the housing, the LED array and is threaded into the array cover to thereby attach the driver board, the housing, the LED array and the array cover together with the driver board outside the housing and the LED array and array cover inside the housing.

3. The lighting fixture of claim 1 wherein at least one screw passes through a plurality of holes in the driver board, the housing, the LED array, and the array cover and is threaded into at least one nut to thereby attach the driver board, the housing, the LED array and the array cover together with the driver board outside the housing and the LED array and array cover inside the housing.

4. The lighting fixture of claim 1 further comprises wiring configured to carry electric power from the driver board to the LED array wherein the housing further comprises at least one wiring hole and wherein the wiring passes through a wiring hole in housing.

5. The lighting fixture of claim 1 further comprising a cover configured to attach to the housing and to cover the driver board.

6. The lighting fixture of claim 1 further comprising a cover, wherein the cover is cylindrically shaped, with an open cover bottom and closed above by a flat top surface, and wherein the cover is attached to the housing to thereby cover the driver board.

7. The lighting fixture of claim 5 wherein the trim flat and the closed cover top are within 1.3 inches of each other when the at least one clip releasably holds the widening flange inside the closed section.

8. A lighting fixture comprising:

a housing comprising a housing inside, a housing top, at least one mounting hole, at least one array attach hole, at least one clip fastener hole, a closed section, wherein the housing inside is within the closed section and capped by the housing top;

a driver board positioned outside of the housing and on the housing top, wherein the driver board comprises a circuit board and at least one electrical component;

a cover attached to the housing and covering the driver board;

a trim comprising a trim flat, a narrowing section, and a widening flange, wherein the trim is a unitary piece, wherein the trim flat surrounds the narrowing section, wherein the narrowing section extends in an upward direction from the trim flat, and wherein the widening flange extends upward from the narrowing section;

at least one clip attached to the inside of the closed section and configured to releasably hold the widening flange inside the closed section;

an LED array within the housing inside and attached to the housing top;

an array cover covering the LED array wherein the array cover is at least 2.5 mm thick.

9. The light fixture of claim 8 wherein the housing is circularly symmetric around a housing axis of rotation.

10. The light fixture of claim 9 wherein the trim is circularly symmetric around the housing axis of rotation.

11. The light fixture of claim 8 wherein the circuit board is single sided and comprises a populated side and a blank side, wherein the at least one electrical component is mounted on the populated side, and wherein the blank side is closer to the housing than the populated side.

12. The light fixture of claim 8 wherein the array cover is polycarbonate.

13. The light fixture of claim 8 wherein the cover comprises a flat top surface, wherein the trim flat and the flat top surface are within 1.3 inches of each other when the at least one clip releasably holds the widening flange inside the closed section.

14. A lighting fixture comprising:

a housing comprising a housing inside, a housing top, at least one mounting hole, at least one array attach hole, at least one clip fastener hole, a closed section, wherein the housing inside is within the closed section and capped by the housing top;

a driver board positioned outside of the housing and on the housing top, wherein the driver board comprises a circuit board and at least one electrical component;

a cover comprising a flat top surface, wherein the cover is attached to the housing and covers the driver board;

a trim comprising a trim flat, a narrowing section, and a widening flange, wherein the trim is a unitary piece, wherein the trim flat surrounds the narrowing section, wherein the narrowing section extends in an upward direction from the trim flat, and wherein the widening flange extends upward from the narrowing section;

at least one clip attached to the inside of the closed section and configured to releasably hold the widening flange inside the closed section, wherein the trim flat is within 1.3 inches of the flat top surface when the at least one clip is releasably holding the widening flange inside the closed section;

an LED array within the housing inside and attached to the housing top; and an array cover covering the LED array such that light from the LED array must pass through the array cover before exiting the lighting fixture.

15. The lighting fixture of claim 14 wherein the array cover is hat shaped and comprises a flat array cover rim and a central dome, wherein the LED array comprises a plurality of LEDs, and wherein the LEDs are enclosed inside the central dome.

16. The lighting fixture of claim 15 wherein the array cover is glass.

17. The lighting fixture of claim 15 wherein the array cover is clear polycarbonate and at least 2.5 mm thick.

18. The lighting fixture of claim 15 further comprising a reflector, wherein the reflector is cone shaped and held in alignment with the LED array by the central dome.

19. The lighting fixture of claim 18 further comprising a lens comprising a plurality of lens tabs, wherein the lens is attached to the trim by the lens tabs, and wherein the reflector is held within the housing by the lens.

20. The lighting fixture of claim 14 wherein the LED array and the array cover are attached to the housing top by at least one screw that passes completely through the array cover, the LED array, and the housing top.

* * * * *